US008620168B2

(12) United States Patent
Itagaki

(10) Patent No.: US 8,620,168 B2
(45) Date of Patent: Dec. 31, 2013

(54) IMAGE FORMING APPARATUS

(75) Inventor: Yuusuke Itagaki, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 203 days.

(21) Appl. No.: 13/161,837

(22) Filed: Jun. 16, 2011

(65) Prior Publication Data

US 2011/0311247 A1 Dec. 22, 2011

(30) Foreign Application Priority Data

Jun. 17, 2010 (JP) ..... 2010-137890

(51) Int. Cl.
*G03G 15/08* (2006.01)
*G03G 21/12* (2006.01)

(52) U.S. Cl.
CPC ..... *G03G 15/0831* (2013.01)
USPC ..... 399/35

(58) Field of Classification Search
USPC ..... 399/35
See application file for complete search history.

(56) References Cited

U.S. PATENT DOCUMENTS 5,970,275 A * 10/1999 Brown et al. ..... 399/27
7,366,457 B2 * 4/2008 Ono ..... 399/344
7,454,148 B2 * 11/2008 Kameda ..... 399/35
8,126,340 B2 * 2/2012 Bito et al. ..... 399/35
2008/0159760 A1 * 7/2008 Okano et al. ..... 399/35
2009/0060536 A1 * 3/2009 Kumagai ..... 399/35
2010/0303484 A1 * 12/2010 Hogan et al. ..... 399/35

FOREIGN PATENT DOCUMENTS

JP 2004-101667 4/2004
JP 2005-241676 9/2005
JP 2007-178787 7/2007
JP 2010-127989 6/2010

* cited by examiner

*Primary Examiner* — Walter L Lindsay, Jr.
*Assistant Examiner* — Philip Marcus T Fadul
(74) *Attorney, Agent, or Firm* — Nixon & Vanderhye P.C.

(57) ABSTRACT

An image forming apparatus includes a weight detection sensor and a CPU (notification control section, weight calculation section and full-capacity amount correction section). The CPU calculates weight of toner in a waste toner container based on image formation history information including the number of image-forming sheets. When weight of toner in the waste toner container detected by the weight detection sensor reaches a semi full-capacity amount, the CPU makes a comparison of a detection value detected by the weight detection sensor with a calculation value calculated by the CPU and corrects a weight value in a full-capacity state with a correction value set based on a result of the comparison.

6 Claims, 5 Drawing Sheets

CONVERSION VALUE (X) IS DECIDED BY NUMBER OF SHEETS (x), PRINTING MODE (y), TRANSFER EFFICIENCY (z) AND CHARGING RATE (w).

$AX=ax+by+cz+dw$ (A, a, b, c AND d ARE CONSTANTS)

IMAGE FORMING APPARATUS

CROSS REFERENCE

This Nonprovisional application claims priority under 35 U.S.C. §119(a) on Patent Application No. 2010-137890 filed in Japan on Jun. 17, 2010, the entire contents of which are hereby incorporated by reference.

BACKGROUND OF THE INVENTION

The present invention relates to image forming apparatuses having a waste toner container to collect and store toner remaining on the surface of an image bearing member after a transferring step.

In electrophotography image forming apparatuses, an electrostatic latent image is formed on the surface of an image bearing member such as a photoreceptor drum or a transfer belt, subsequently a toner image is formed thereon, and thereafter the toner image is transferred from the image bearing member to a sheet. Toner not transferred to the sheet but remaining on the surface of the image bearing member is collected in a waste toner container via a cleaning unit or the like for storage.

As the number of sheets subjected to image formation (hereinafter called the number of image-forming sheets) increases, the amount of waste toner in the waste toner container increases and the waste toner container becomes full in due time. If waste toner is further collected in the waste toner container in a full-capacity state, a problem will arise, such as overflow of waste toner from the waste toner container. To avoid this, conventional image forming apparatuses enter a disabled state when the waste toner container becomes full, and issue an alarm to urge a user to replace the waste toner container.

Some of the image forming apparatuses are configured for smooth replacement of the waste toner container so as to issue an alarm before entering the disabled state and when the waste toner container is approaching replacement time (for instance, see JP 2004-101667 A, called Patent Document 1).

The conventional techniques including Patent Document 1, however, sometimes fail to detect the amount of waste toner in the waste toner container precisely. For instance, in the configuration detecting the weight of waste toner using a spring provided below the waste toner container, precise weight cannot be detected in some cases because of variations of spring accuracy or imbalance in toner distribution. In another case of detecting the amount of waste toner in the waste toner container on the basis of image formation information such as the number of image-forming sheets, the amount of waste toner even for the same number of image-forming sheets varies with the frequency of color printing and monochrome printing, a print density, a type of an image printed and the like.

Such a failure results in the difficulty to detect an appropriate replacement time for the waste toner container, sometimes causing the overflow of waste toner from the waste toner container or unnecessary replacement of the waste toner container in spite of enough space left in the waste toner container.

It is an object of the present invention to provide an image forming apparatus capable of detecting an appropriate replacement time of a waste toner container.

SUMMARY OF THE INVENTION

An image forming apparatus according to the present invention includes a waste toner container that collects and stores toner remaining on a surface of an image bearing member after a transferring step. This image forming apparatus includes a weight detection section, a notification control section, a weight calculation section and a full-capacity amount correction section.

The weight detection section measures weight of the waste toner container so as to detect weight of toner in the waste toner container. When weight of toner in the waste toner container detected by the weight detection section reaches a full-capacity amount set beforehand and when weight of toner in the waste toner container detected by the weight detection section reaches a semi full-capacity amount set beforehand, the semi full-capacity amount being smaller than the full-capacity amount, the notification control section makes a notification as such to a user.

The weight calculation section calculates weight of toner in the waste toner container based on image formation history information including the number of image-forming sheets. When weight of toner in the waste toner container detected by the weight detection section reaches the semi full-capacity amount, the full-capacity amount correction section makes a comparison of a detection value detected by the weight detection section with a calculation value calculated by the weight calculation section, and corrects a value of the full-capacity amount with a correction value set based on a result of the comparison.

Herein, the correction value set by the full-capacity amount correction section may be a value corresponding to a difference between the detection value detected by the weight detection section and the calculation value calculated by the weight calculation section. The full-capacity amount correction section adds the correction value to the full-capacity amount, for example, when weight of toner in the waste toner container detected by the weight detection section reaches the semi full-capacity amount and when the detection value detected by the weight detection section is larger than the calculation value calculated by the weight calculation section.

In this configuration, when weight of toner in the waste toner container detected by the weight detection section reaches a semi full-capacity amount, a detection value detected by the weight detection section as well as a calculation value calculated by the weight calculation section are referred to for correction of a value of a full-capacity amount, and therefore a more appropriate value of full-capacity amount can be obtained. As a result, a problem such as generation of a replacement alarm by mistake in spite of enough space left in the waste toner container to make the image forming apparatus in a disabled state can be prevented.

DETAILED DESCRIPTION OF THE INVENTION

Figure 1:
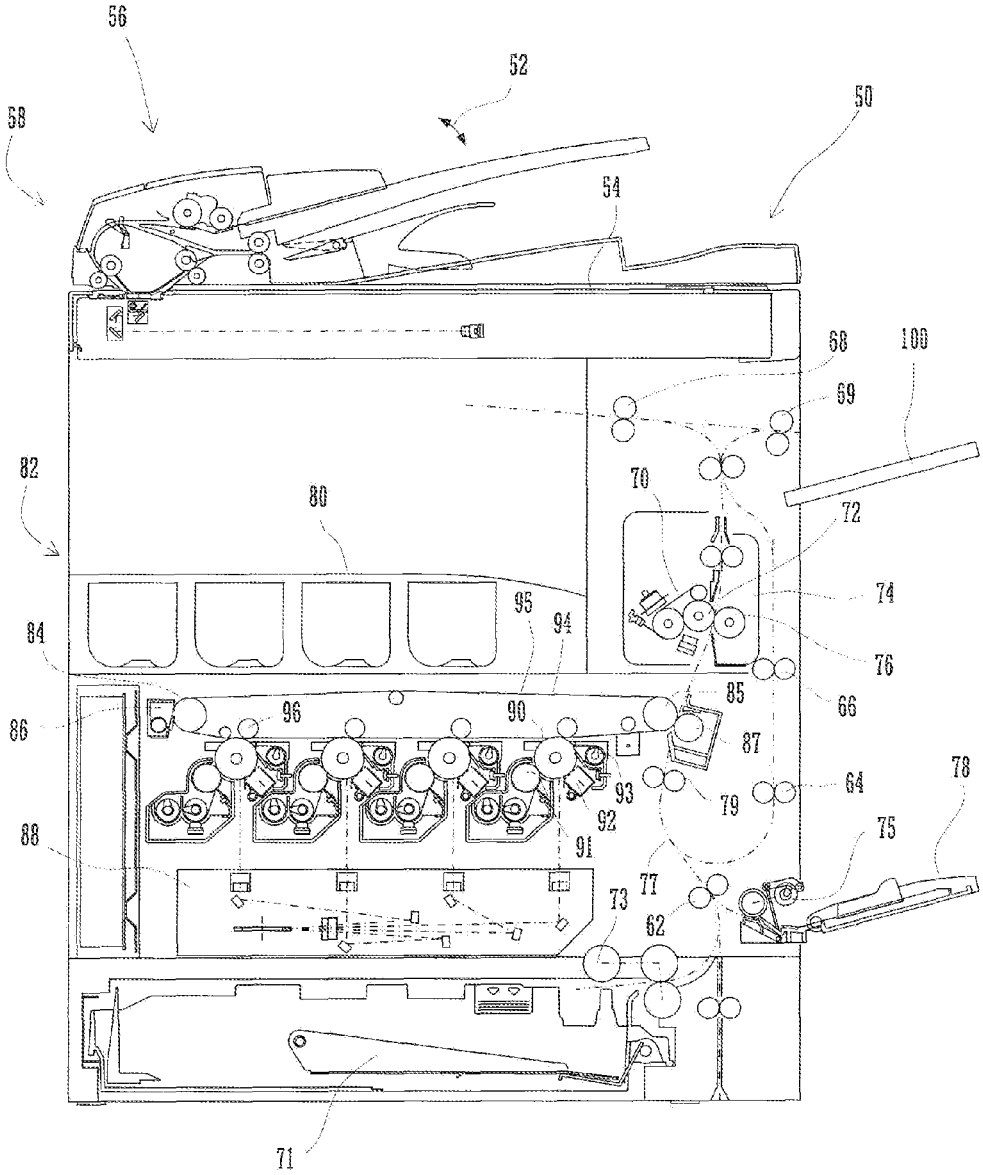
FIG. 1 schematically illustrates an image forming apparatus according to one embodiment of the present invention.

FIG. 1 schematically illustrates an image forming apparatus 50 according to one embodiment of the present invention. The image forming apparatus 50 forms multicolored or single-colored images on a predetermined sheet (recording sheet) in accordance with image data externally transmitted, and includes an image forming section 82 and a document reader 58.

The image forming section 82 includes four image formation stations each forming a color image in black (K), cyan (C), magenta (M) or yellow (Y). Each image formation station includes a development unit 91, a photoreceptor drum 90, a cleaner unit 93 and a charger 92.

The image forming section 82 further includes an optical scanning device 88, an intermediate transfer belt unit 95, a fixing unit 74, a paper feeding cassette 71, a first copy receiving tray 80, a second copy receiving tray 100, a plurality of flappers (not illustrated) to change a conveyance direction of a sheet and the like.

Above the image forming section 82 is provided a document platen 54 made of transparent glass on which a document is placed, and above the document platen 54 is installed an automatic document processor 56. The automatic document processor 56 automatically conveys a document onto the document platen 54. The automatic document processor 56 is configured rotatably to leave the document platen 54 open so that a document can be manually placed on the document platen 54.

The charger 92 is means to uniformly charge the surface of the photoreceptor drum 90 at a predetermined electrical potential, which may be a contact type charger such as a roller or a brush instead of a non-contact type charger as illustrated in FIG. 1.

The optical scanning device 88 is configured to form an electrostatic latent image on the surface of each photoreceptor drum 90 in accordance with image data input.

Each development unit 91 makes the electrostatic latent image formed on the corresponding photoreceptor drum 90 visible with toner in one of the four colors. The cleaner unit 93 removes and collects toner remaining on the surface of the photoreceptor drum 90 after a transferring step.

The intermediate transfer belt unit 95 disposed above the photoreceptor drums 90 includes an intermediate transfer belt 94, an intermediate transfer belt driving roller 85, an intermediate transfer belt slave roller 84, four intermediate transfer rollers 96, and an intermediate transfer belt cleaning unit 86.

The intermediate transfer belt driving roller 85, the intermediate transfer belt slave roller 84 and the intermediate transfer rollers 96 are configured to stretch the intermediate transfer belt 94 therebetween. Each intermediate transfer roller 96 is configured to transfer a toner image on the corresponding photoreceptor drum 90 onto the intermediate transfer belt 94.

The intermediate transfer belt 94 is provided to come into contact with each photoreceptor drum 90, and has a function to let a toner image in each color formed on the photoreceptor drum 90 to be transferred and subsequently overlaid thereon, so that a color toner image (multicolored toner image) is formed on the intermediate transfer belt 94. The intermediate transfer belt 94 is formed as an endless belt using film of 100 μm to 150 μm in thickness, for example.

When toner images are transferred from the photoreceptor is drums 90 to the intermediate transfer belt 94, a transfer bias of a high voltage (high voltage with reversed polarity (+) of the polarity (−) of charged toner) is applied to the intermediate transfer rollers 96 for transferring of the toner images. Each of the intermediate transfer rollers 96 is a roller including a metal (e.g., stainless steel) shaft of 8 to 10 mm in diameter as a base that is surrounded by a conductive elastic material (e.g., EPDM or urethane foam). This conductive elastic material enables the uniform application of a high voltage to the intermediate transfer belt 94. The present embodiment uses the transfer electrodes in a roller shape, but not limited to, and a brush type transfer electrode may be used for example.

As stated above, the electrostatic image is made visible on each photoreceptor drum 90 in the corresponding color, and is overlaid on the intermediate transfer belt 94. As the intermediate transfer belt 94 rotates, the thus overlaid image information is transferred onto a sheet by a secondary transfer roller 87 described below that is disposed at a contact position of the sheet and the intermediate transfer belt 94.

At this time, the intermediate transfer belt 94 and the secondary transfer roller 87 are brought into contact with each other by pressurizing at a predetermined nip, while a voltage (high voltage with reversed polarity (+) of the polarity (−) of charged toner) is applied to the secondary transfer roller 87 for transferring of the toner onto a sheet. In order to allow the secondary transfer roller 87 to give the above-stated nip steadily, any one of the secondary transfer roller 87 and the intermediate transfer belt driving roller 85 may be made of a hard material (e.g., metal), and the other may be made of a soft material (e.g., elastic rubber roller or foaming resin roller) such as an elastic roller.

Meanwhile, toner is adhered to the intermediate transfer belt 94 as a result of the contact with the photoreceptor drums 90 or toner remains on the intermediate transfer belt 94 without being transferred to a sheet by the secondary transfer roller 87, and such toner causes the mixture of colors of toner at a following step. In order to avoid this, the intermediate transfer belt cleaning unit 86 is provided to remove and collect such toner. The intermediate transfer belt cleaning unit 86 is provided with a cleaning blade, for example, as cleaning member coming into contact with the intermediate transfer belt 94, and at a portion of the intermediate transfer belt 94 coming into contact with the cleaning blade, the intermediate transfer belt 94 is supported by the intermediate transfer belt slave roller 84 from the opposite side.

The paper feeding cassette 71 is a tray for storing sheets (recording sheets) used for image formation, and is disposed below the optical scanning device 88 of the image forming section 82. The sheets used for image formation may be placed on a manual paper feeding cassette 78 as well.

The first copy receiving tray 80 is disposed above the image forming section 82, and is configured so that sheets subjected to printing are piled up while letting the printed side face downward. On the other hand, the second copy receiving tray 100 is disposed outside the casing of the image forming apparatus 50, and is configured so that sheets subjected to printing are piled up while letting the printed side face upward.

The image forming section 82 is provided with a substantially vertical sheet conveyance path 77 to send a sheet from the paper feeding cassette 71 or the manual paper feeding cassette 78 to the first copy receiving tray 80 or the second copy receiving tray 100 via the secondary transfer roller 87 and the fixing unit 74. In the vicinity of the sheet conveyance path 77 from the paper feeding cassette 71 and the manual paper feeding cassette 78 to the first copy receiving tray 80 and the second copy receiving tray 100 are disposed pickup rollers 73 and 75, a plurality of conveyance rollers 62, 64, 66 and 68, paper stop rollers 79, the secondary transfer roller 87 and the fixing unit 74, for example.

The conveyance rollers 62, 64, 66 and 68 are small rollers to promote and assist the conveyance of a sheet, and a plurality of these rollers are provided along the sheet conveyance path 77. The pickup roller 73 is provided in the vicinity of an end of the paper feeding cassette 71 so as to pick up sheets one by one from the paper feeding cassette 71 and supply the sheet to the sheet conveyance path 77. Similarly, the pickup roller 75 is provided in the vicinity of an end of the manual paper feeding cassette 78 so as to pick up sheets one by one from the manual paper feeding cassette 78 and supply the sheet to the sheet conveyance path 77.

The paper stop rollers 79 hold a sheet conveyed along the sheet conveyance path 77 once. Then, the paper stop rollers 79 function to convey the sheet to the secondary transfer roller 87 at timing when a front end of a toner image on the intermediate transfer belt 94 and a front end of the sheet are aligned.

The fixing unit 74 includes a heat roller 72 and a pressure roller 76, and the heat roller 72 and the pressure roller 76 rotate while sandwiching a sheet therebetween. The heat roller 72 is set at a predetermined fixing temperature by a controller on the basis of a signal from a temperature detector not illustrated. The heat roller 72 as well as the pressure roller 76 have a function to heat and pressurize toner with respect to a sheet to melt, mix and pressurize a multicolored toner image transferred on the sheet for heat fixing. An external heating belt 70 is further provided to heat the heat roller 72 externally.

The following describes the sheet conveyance path in detail. As stated above, the image forming apparatus is provided with the paper feeding cassette 71 for storing sheets beforehand and the manual paper feeding cassette 78. In order to feed a sheet from these paper feeding cassettes 71 and 78, the pickup rollers 73 and 75 are provided, respectively, so as to guide sheets one by one to the conveyance path 77.

A sheet is conveyed from the paper feeding cassette 71 or the manual paper feeding cassette 78 to the paper stop rollers 79 by the conveyance rollers 62 in the sheet conveyance path 77. Then, the sheet is conveyed to the secondary transfer roller 87 at timing when a front end of the sheet is aligned with a front end of image information on the intermediate transfer belt 94, and the image information is written on the sheet. Thereafter, the sheet passes through the fixing unit 74 so that unfixed toner is melt and fixed for adhesion to the sheet by heat, and is discharged via the conveyance rollers 68 provided downstream onto the first copy receiving tray 80 or the second copy receiving tray 100.

The above-stated conveyance path is for single-sided printing. On the other hand, in the case of double-sided printing, a sheet subjected to single-sided printing as stated above and passing through the fixing unit 74 is held at its rear end by the finally disposed conveyance rollers 68. Thereafter, the conveyance rollers 68 rotate reversely and flappers (not illustrated) are changed in their positions so as to guide the paper to a returning conveyance path along which the conveyance rollers 66 and 64 are disposed. The sheet is conveyed from the returning conveyance path to the contact position with the intermediate transfer belt 94 via the paper stop rollers 79, where printing is performed on the rear face of the sheet. The sheet is then discharged to the first copy receiving tray 80.

In the above-stated configuration, toner remaining on the photoreceptor drum 90 is collected by the cleaner unit 93 and toner remaining on the intermediate transfer belt 94 is collected by the intermediate transfer belt cleaning unit 86, and such toner is collected via a conveyance section including a screw and the like to a waste toner container 10 (not illustrated) for storage.

Figure 2:
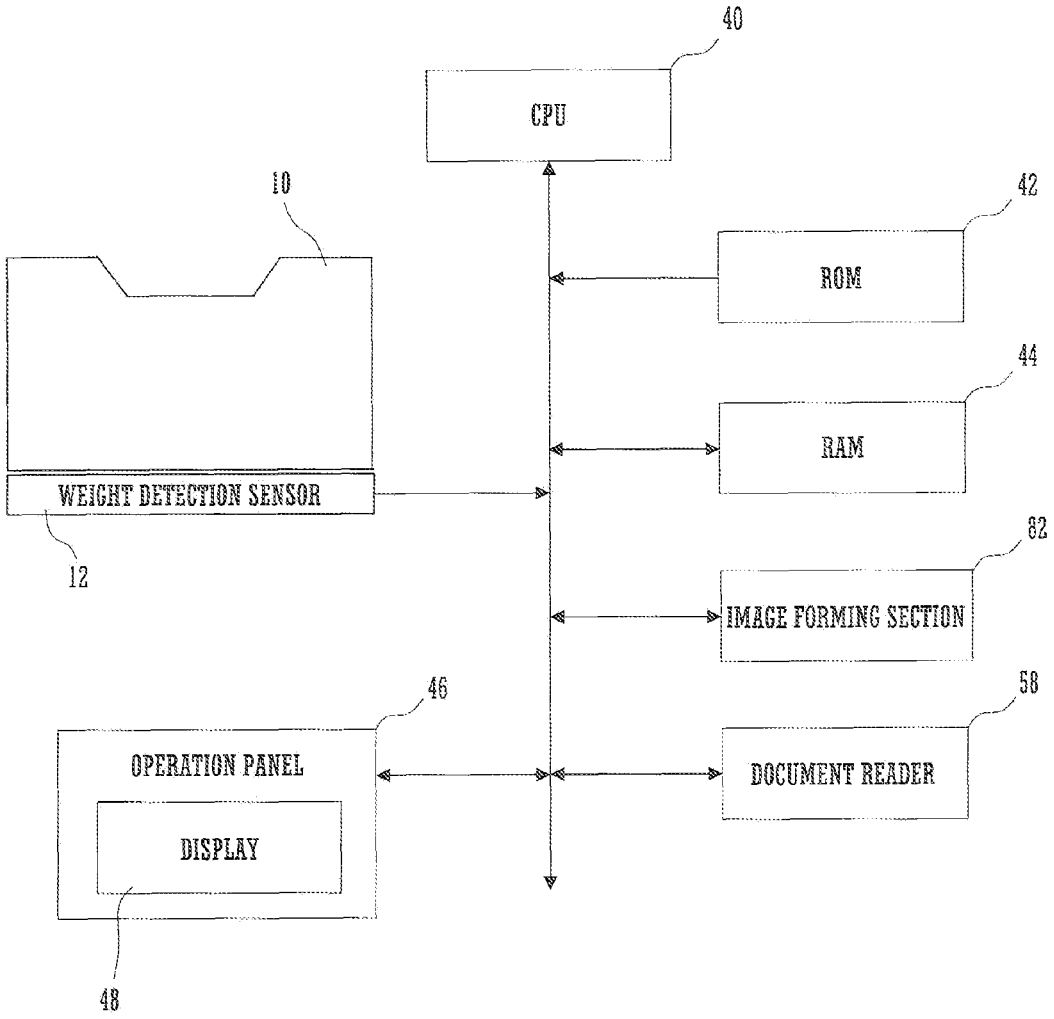
FIG. 2 is a block diagram schematically illustrating an image forming apparatus according to one embodiment of the present invention.

FIG. 2 is a block diagram schematically illustrating the image forming apparatus 50. As illustrated in this drawing, the image forming apparatus 50 includes a ROM 42, a RAM 44, an operation panel 46 and a CPU 40. The ROM 42 stores a plurality of programs necessary for the operation of the image forming apparatus 50. The RAM 44 is a volatile memory that the CPU 40 can directly access. The operation panel 46 includes a plurality of operation keys accepting an input operation from users, and a display 48 to display necessary information to users. The CPU 40 is configured to comprehensively control the operation of the respective parts of the image forming apparatus 50 on the basis of the programs stored in the ROM 42.

The CPU 40 further is connected to a weight detection sensor 12. The weight detection sensor 12 is disposed below the waste toner container 10, and is configured to measure the weight of the waste toner container 10 so as to detect the weight of toner in the waste toner container 10.

The present embodiment does not use a conventional method that detects a full-capacity state or a semi full-capacity state in the waste toner container 10 only on the basis of a value detected by the weight detection sensor 12. In the present embodiment, a full-capacity state or a semi full-capacity state in the waste toner container 10 is detected by referring to not only the value detected by the weight detection sensor 12 but also the weight understood from an approximate curve that is obtained by the calculation based on history information on image formation including the number of image-forming sheets and so on. Herein, the full-capacity state refers to the state where the container is full of waste toner so that image formation processing cannot be performed until the waste toner container is replaced. The semi full-capacity state refers to the state where the container is filled with toner of 70 to 80% of the full-capacity state and a user is preferably noticed of the replacement time.

Figure 3A:
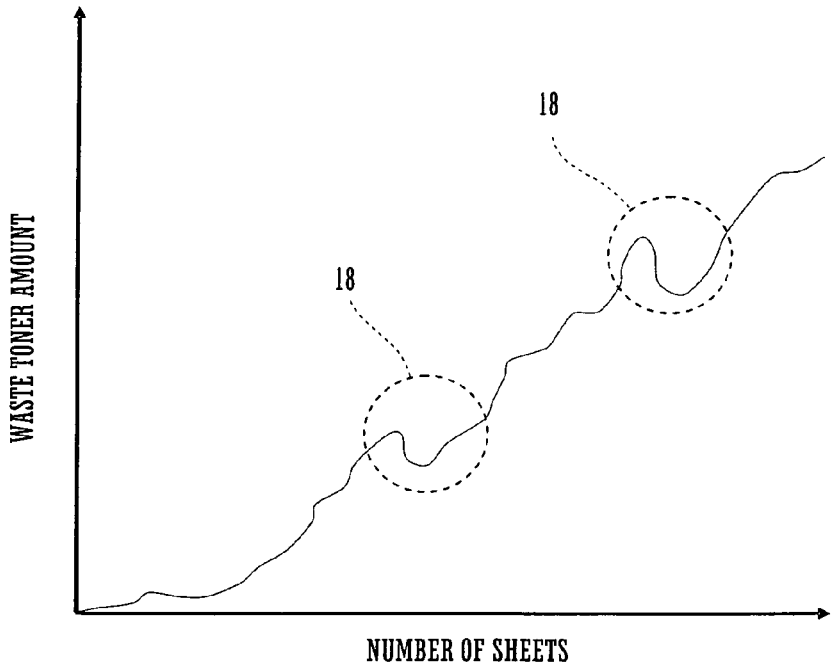
FIG. 3A illustrates a relationship between image formation history information and a waste toner amount.
Figure 3B:
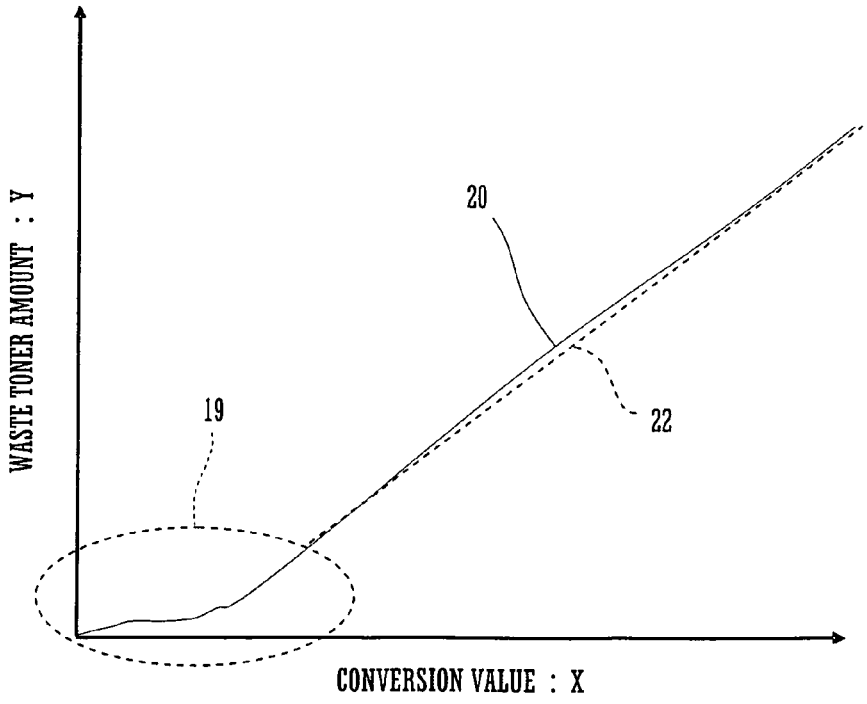
FIG. 3B illustrates a relationship between image formation history information and a waste toner amount.

Referring next to FIGS. 3A and 3B, the following describes an example of obtaining an approximate curve and an approximate line on the basis of image formation history information including the number of image-forming sheets and so on. In FIG. 3A, the horizontal axis represents the number of image-forming sheets and the vertical axis represents the weight of waste toner. In FIG. 3B, the horizontal axis represents converted values obtained based on the number of image-forming sheets and the like, and the vertical axis represents the weight of waste toner.

The weight of waste toner varies with an image formation mode (color/monochrome, density and the like), transfer efficiency and a charging rate as well as with the number of image-forming sheets. Then, in the present embodiment, a conversion rate (X) is defined including these four parameters of the number of image-forming sheets (x), the image formation mode (y), the transfer efficiency (z) and the charging rate (w). Then, an approximate curve 20 and an approximate line 22 are configured using this conversion rate (X) so as to represent a correspondence between the number of image-forming sheets and the weight of waste toner, and the weight is calculated by systematic detection for the semi full-capacity state on the basis of these approximate curve 20 and approximate line 22.

This conversion rate (X) may be represented by the expression of $AX=ax+by+cz+dw$ (A, a, b, c and d are constants), for example. Graphing and organizing this conversion rate (X) on the horizontal axis can lead to the approximate curve 20 and the approximate line 22 illustrated in FIG. 3B.

Herein, when finding this approximate line 22, it is preferable not to include a range where the amount of waste toner in the waste toner container 10 does not reach a predetermined amount (e.g., 20% of the container capacity). This is because, in a region 19 where the amount of waste toner does not reach the predetermined level, errors in the weight of the waste toner container 10 itself or in the spring load of the weight detection sensor 12 tend to have a great influence. To this end, the waste toner container 10 is preferably provided with a waste toner detection sensor to detect that the amount of waste toner in the waste toner container 10 reaches a predetermined amount (e.g., 20% of the container capacity).

Further, when a pile of waste toner collapses in the waste toner container 10 due to vibration, for example, an error might occur in the weight, and therefore a portion 18 with great irregularities in the curve indicating a relationship between the number of image-forming sheets and the waste toner weight of FIG. 3A also is preferably removed to find the approximate curve 20 and the approximate line 22. In this way, the weight is calculated from the approximate line 22 that is found systematically on the basis of the image formation history information including the number of image-forming sheets and the like, and such a weight is referred to at the time of a semi full-capacity state, whereby a full-capacity state can be detected more precisely than in the conventional techniques.

Figure 4:
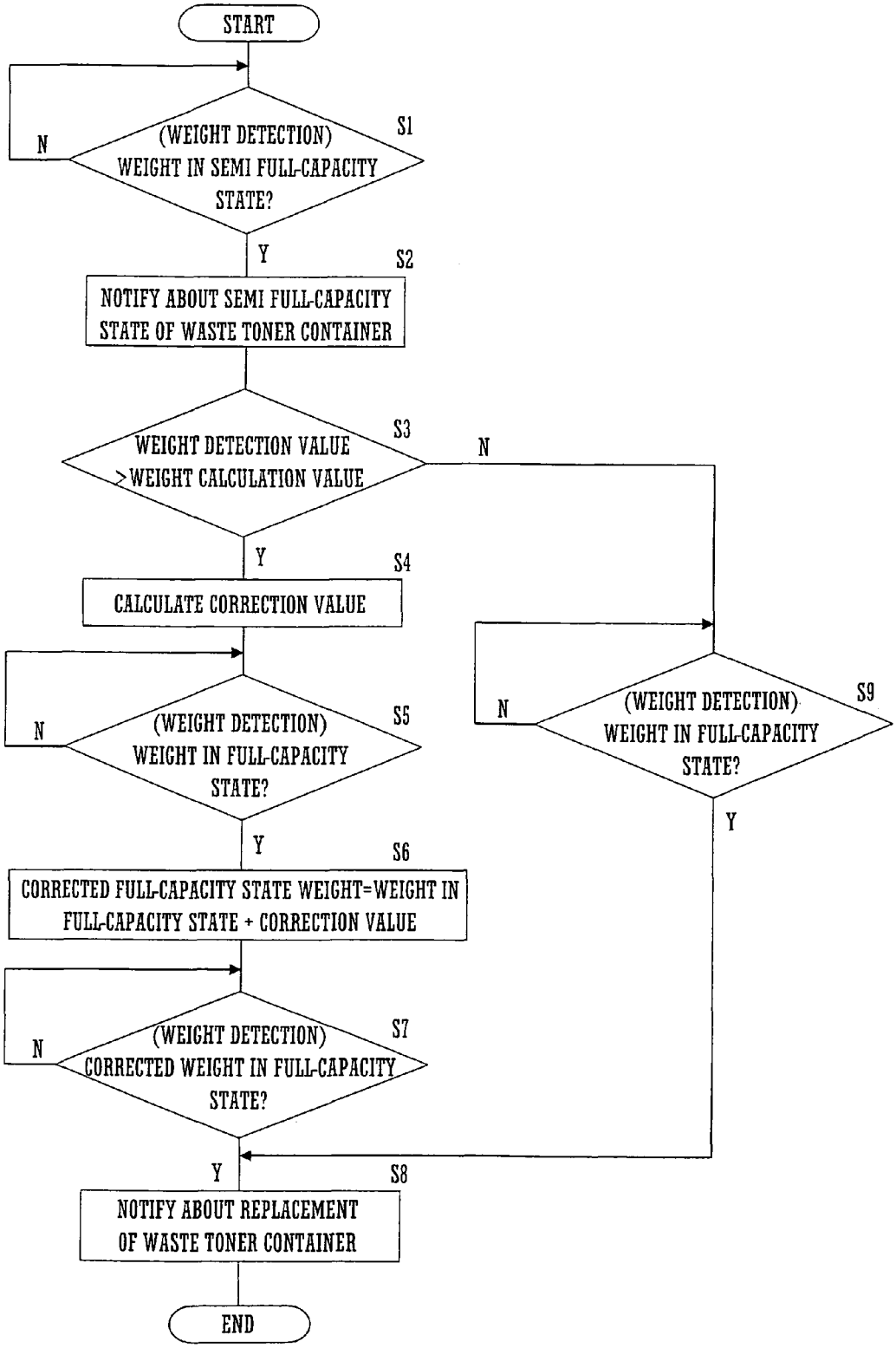
FIG. 4 is a flowchart illustrating the procedure of full-capacity detection processing for waste toner in an image forming apparatus.

FIG. 4 is a flowchart illustrating the procedure by the CPU 40 in the full-capacity detection processing for the waste toner container 10 in the image forming apparatus 50. Firstly, the CPU 40 stands by until the detection value of the weight detection sensor 12 reaches a weight value corresponding to the semi full-capacity state set beforehand (S1).

At the stand-by step of S1, when the detection value of the weight detection sensor 12 reaches the weight value corresponding to the semi full-capacity state set beforehand, the CPU 40 makes the display 48 display the semi full-capacity state of the waste toner container 10 (S2).

Figure 5A:
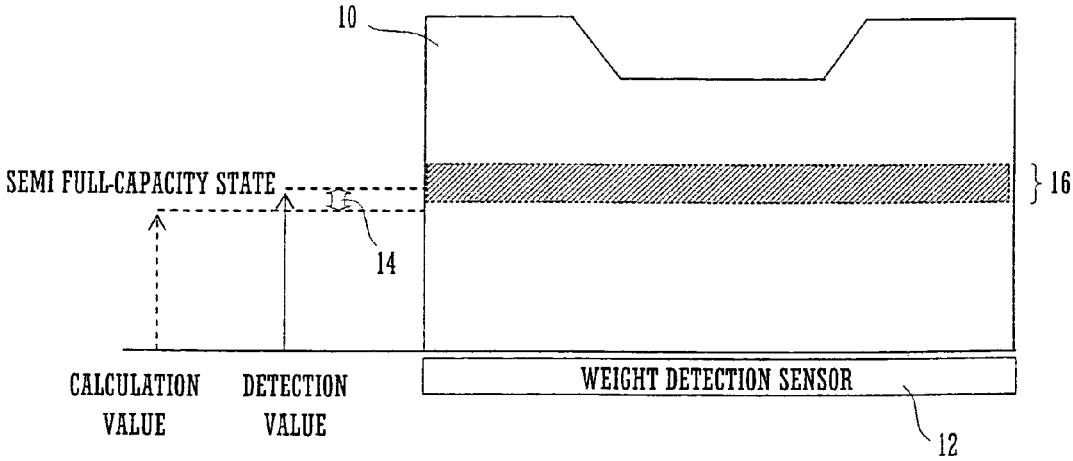
FIG. 5A illustrates a semi full-capacity state of waste toner.

Subsequently, the CPU 40 determines whether the detection value of the weight detection sensor 12 exceeds or not a calculation value obtained from the approximate line 22 of FIG. 3B (S3). At the determination step of S3, if the detection value exceeds the calculation value, the CPU 40 calculates a correction value to be applied to a weight value indicating the full-capacity state (S4). In the present embodiment, as illustrated in FIG. 5A, when the waste toner container 10 reaches the semi full-capacity state, comparison is made between the weight value indicated by the weight detection sensor 12 and the above-stated calculation value, and a correction value 14 is calculated by subtracting the calculation value from the weight value indicated by the weight detection sensor 12. Note here that, in FIGS. 5A to 5C, a region indicated with reference numeral 16 is the error range of the weight detection by the weight detection sensor 12.

Thereafter, the CPU 40 stands by until the detection value of the weight detection sensor 12 reaches a weight value indicating an original full-capacity state (S5). Then, even when the detection value of the weight detection sensor 12 reaches the weight value indicating the original full-capacity state, the CPU 40 does not issue an alarm for replacement of the waste toner container 10 nor make the image forming apparatus 50 in a disabled state.

Figure 5B:
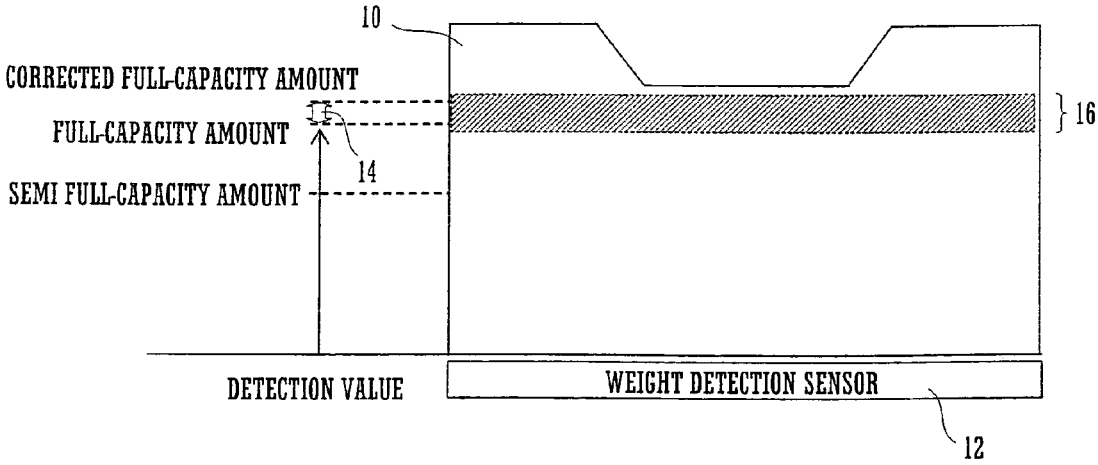
FIG. 5B illustrates a full-capacity state of waste toner.
Figure 5C:
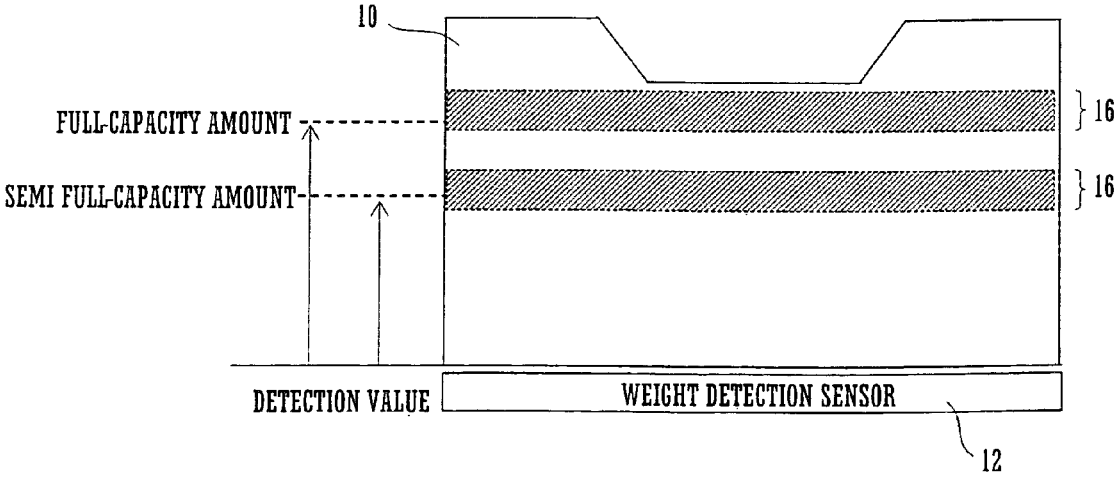
FIG. 5C illustrates a full-capacity state and a semi full-capacity state of waste toner.

At this time, as illustrated in FIG. 5B, the CPU 40 calculates a corrected weight value by adding the correction value 14 to the weight value indicating the original full-capacity state (S6). Subsequently, the CPU 40 stands by until the detection value by the weight detection sensor 12 reaches the corrected weight value that is calculated at Step S6 (S7). Then, when the detection value by the weight detection sensor 12 reaches the corrected weight value, the CPU 40 makes the display 48 display an alarm indicating that the waste toner container 10 is to be replaced and makes the image forming apparatus 50 in a disabled state (S8).

At the above-stated determination step of S3, if the detection value does not exceed the calculation value, the CPU 40 skips the procedure of adding the correction value 14 to the weight value indicating the original full-capacity state described at S4 to S7, and when the detection value of the weight detection sensor 12 reaches the weight value indicating the original full-capacity state, the CPU 40 makes the display unit 48 display an alarm indicating that the waste toner container 10 is to be replaced, and makes the image forming apparatus 50 in a disabled state (S9 and S8).

According to the present embodiment, the filling rate of the waste toner container with waster toner can be increased. As a result, as compared with the configuration of FIG. 5C that refers to the detection value of the weight detection sensor 12 only, the frequency of a user to make a contact for replacement of the waste toner container can be decreased, and the trouble for a serviceman to visit the site and replace the waste toner container 10 can be reduced.

In the above-stated embodiment, a user is notified of an alarm or the like via the display 48. In another configuration, a user may be notified by sound, for example.

The above described embodiments are to be considered in all respects as illustrative and not restrictive. The scope of the invention is indicated by the appended claims rather than by the foregoing description. All changes which come within the meaning and range of equivalency of the claims are intended to be embraced therein.

What is claimed is:

1. An image forming apparatus, comprising:

a waste toner container that collects and stores toner remaining on a surface of an image bearing member after a transferring step;

a weight detection section that measures a weight of the waste toner container so as to detect a weight of toner in the waste toner container;

a notification control section that, when the weight of the toner in the waste toner container detected by the weight detection section reaches a predetermined full-capacity amount, and when the weight of the toner in the waste toner container detected by the weight detection section reaches a predetermined semi full-capacity amount, the semi full-capacity amount being smaller than the full-capacity amount, makes a notification as such to a user;

a weight calculation section that calculates a weight of the toner in the waste toner container based on image formation history information including the number of image-forming sheets; and a full-capacity amount correction section that, when the weight of the toner in the waste toner container detected by the weight detection section reaches the predetermined semi full-capacity amount, makes a comparison of a detection value detected by the weight detection section with a calculation value calculated by the weight calculation section which is based on the image formation history information that is collected before the weight of the toner in the waste toner container as detected by the weight detection section reaches the predetermined semi full-capacity amount, and corrects the pre-determined full-capacity amount with a correction value set based on a result of the comparison.

2. The image forming apparatus according to claim 1, wherein the correction value set by the full-capacity amount correction section is a value corresponding to a difference between the detection value detected by the weight detection section and the calculation value calculated by the weight calculation section, and the full-capacity amount correction section adds the correction value to the full-capacity amount when the weight of toner in the waste toner container detected by the weight detection section reaches the semi full-capacity amount and when the detection value detected by the weight detection section is larger than the calculation value calculated by the weight calculation section.

3. The image forming apparatus according to claim 1, further comprising a waste toner detection section that detects when the weight of the toner in the waste toner container reaches a predetermined amount less than the semi full-capacity amount, wherein the full-capacity amount correction section sets the correction value without considering information generated before the waste toner detection section detects that the weight of the toner in the waste toner container has reached the predetermined amount.

4. The image forming apparatus according to claim 1, further comprising:

central processing unit (CPU) that controls operations of elements of the image forming apparatus;

a random access memory (ROM) that stores a plurality of programs necessary for the operation of the image forming apparatus; and a random access memory (RAM) that is a volatile memory that the CPU can directly access, wherein the CPU creates in the RAM a graph indicating a correspondence between the image formation history information and the weight of the toner in the waste toner container using programs stored in the ROM.

5. The image forming apparatus according to claim 4, further comprising a waste toner detection section that detects when the weight of the toner in the waste toner container reaches a predetermined amount less than the semi full-capacity amount, wherein for creation of the graph, the weight calculation section does not consider information generated before the waste toner detection section detects that the weight of toner in the waste toner container has reached the predetermined amount.

6. The image forming apparatus according to claim 4, wherein for creation of the graph, the weight calculation section excludes a portion of a curve indicating a relationship between the number of image-forming sheets and the weight of the toner in the waste toner container, the portion having irregularities of a predetermined value or greater.

* * * * *